US010145158B2

(12) United States Patent
Grela et al.

(10) Patent No.: US 10,145,158 B2
(45) Date of Patent: Dec. 4, 2018

(54) CABINET

(71) Applicants: Larry Mitchell Grela, Plainfield, IL (US); Edwin Dizon Manalang, Burbank, IL (US)

(72) Inventors: Larry Mitchell Grela, Plainfield, IL (US); Edwin Dizon Manalang, Burbank, IL (US)

( * ) Notice: Subject to any disclaimer, the term of this patent is extended or adjusted under 35 U.S.C. 154(b) by 0 days.

(21) Appl. No.: 15/732,801

(22) Filed: Dec. 28, 2017

(65) Prior Publication Data

US 2018/0125236 A1 May 10, 2018

Related U.S. Application Data

(63) Continuation of application No. 15/330,738, filed on Oct. 31, 2016, now Pat. No. 9,894,996.

(51) Int. Cl.

| | |
|---|---|
| ***E05D 11/00*** | (2006.01) |
| ***E05D 15/48*** | (2006.01) |
| ***E05D 15/58*** | (2006.01) |
| ***E06B 3/50*** | (2006.01) |

(52) U.S. Cl.

CPC ..... *E05D 11/00* (2013.01); *E05D 15/48* (2013.01); *E05D 15/58* (2013.01); *E06B 3/509* (2013.01); *E06B 3/5045* (2013.01); *E05D 2015/485* (2013.01); *E05D 2015/586* (2013.01)

(58) Field of Classification Search

CPC ..... A47B 96/00; A47B 91/02; E05D 11/00; E05D 15/48; E05D 15/58; E05D 2015/485; E05D 2015/586; E06B 3/509

See application file for complete search history.

(56) References Cited

U.S. PATENT DOCUMENTS

| | | | | | |
|---|---|---|---|---|---|
| 258,175 | A | | 5/1882 | Waterman | |
| 1,110,231 | A | | 2/1916 | Elint | |
| 1,355,692 | A | * | 10/1920 | Reymann | E05D 15/58 109/70 |
| 1,513,849 | A | * | 11/1924 | Moore | E05G 1/024 109/70 |
| 1,987,822 | A | * | 1/1935 | Theodore | A61C 19/02 206/223 |
| 2,286,427 | A | * | 6/1942 | Levensten | B25H 3/02 190/5 |
| 2,525,208 | A | * | 10/1950 | Clink | B25H 1/12 206/373 |

(Continued)

FOREIGN PATENT DOCUMENTS

GB 2069 915 A 9/1981

OTHER PUBLICATIONS

International Search Report for PCT Application No. PCT US2010/001732, dated Aug. 5, 2010.

(Continued)

*Primary Examiner* — Hanh V Tran
(74) *Attorney, Agent, or Firm* — John G. Chupa

(57) ABSTRACT

A cabinet 10 having at least one door 32 which may be selectively and removably placed within the generally hollow storage compartment 14 of the cabinet 10 and which may be also moved outside of the compartment 14 and allowed to selectively articulate along movement arc 120 and to be selectively placed in a closed position in which the at least one door 32 overlays the storage cavity or compartment 14.

8 Claims, 12 Drawing Sheets

(56) References Cited

U.S. PATENT DOCUMENTS 2,981,549 A 4/1961 Richardson
3,070,340 A 12/1962 Cohn
D205,523 S 8/1966 Doman
3,456,995 A * 7/1969 Nyquist ..... E05D 15/58 312/110
3,520,583 A * 7/1970 Case ..... A47B 81/00 108/28
D229,262 S 11/1973 Pearson
3,848,942 A * 11/1974 Fanini ..... A47B 47/042 312/111
3,848,943 A * 11/1974 Geesaman ..... A47B 81/04 206/373
3,954,202 A * 5/1976 Petrick ..... B42F 17/12 220/533
4,108,514 A * 8/1978 Zimmerman ..... A47B 81/06 312/107
4,120,549 A 10/1978 Bureau
4,211,455 A * 7/1980 Tedrow ..... B25H 3/02 206/373
4,266,835 A * 5/1981 Schmidt ..... B25H 3/02 312/244
4,303,158 A * 12/1981 Perkins ..... B25H 3/02 206/373
4,365,720 A 3/1982 Kaneshiro
D271,733 S 12/1983 Daventry
D273,906 S 5/1984 Norlin
D282,263 S 1/1986 Ahn
D283,263 S 4/1986 Richey
D292,937 S 11/1987 Richey
4,815,797 A * 3/1989 Haab ..... E05D 15/58 312/322
4,821,375 A * 4/1989 Kozon ..... E05D 15/58 16/360
4,830,198 A 5/1989 Colquitt
4,974,912 A * 12/1990 Rask ..... E05D 15/58 312/110
5,108,165 A * 4/1992 Rorke ..... A47B 96/00 312/322
5,149,180 A * 9/1992 Haab ..... E05D 15/58 312/322
D337,404 S 7/1993 Miles
5,292,191 A * 3/1994 Slivon ..... A47B 95/02 292/128
D356,703 S 3/1995 Dickinson
5,395,165 A * 3/1995 Woerner ..... E05D 15/58 211/27
5,443,311 A 8/1995 Kadlecek et al.
5,497,878 A 3/1996 Sandonato
D374,532 S 10/1996 Pool
D387,926 S 12/1997 Blaesing
5,857,757 A 1/1999 Bieker et al.
5,927,838 A * 7/1999 Hellman, Jr. ..... A47B 47/02 312/257.1
5,951,129 A * 9/1999 Stein ..... B23H 3/00 206/373
D423,817 S 5/2000 Holcomb et al.
D423,818 S 5/2000 Holcomb et al.
D427,807 S 7/2000 Holcomb et al.
D430,426 S 9/2000 Bieker et al.
D444,930 S 7/2001 Brown
D448,168 S 9/2001 Johnston
D448,586 S 10/2001 O'hare et al.
6,375,235 B1 * 4/2002 Mehmen ..... E05B 65/46 292/128
6,422,386 B1 * 7/2002 Wiese ..... A45C 5/00 206/373
6,527,353 B1 * 3/2003 Bradfish ..... E05B 65/46 292/102
6,811,232 B2 11/2004 Doan et al.
D505,237 S 5/2005 Schmidt et al.
D514,854 S 2/2006 Schmidt et al.
D520,784 S 5/2006 Schmidt et al.
7,048,347 B1 * 5/2006 Liu ..... B25H 3/028 312/332.1
D523,607 S 6/2006 Huguet
7,121,638 B1 * 10/2006 Eggert ..... B25H 3/028 312/332.1
D536,202 S 2/2007 Mehmen et al.
7,268,518 B1 9/2007 Goff
7,296,808 B2 * 11/2007 Huguet ..... A47B 95/043 280/47.34
D563,119 S 3/2008 Malley et al.
RE40,267 E 4/2008 Mehmen
D574,628 S 8/2008 Grela
7,510,078 B2 * 3/2009 Schmidt ..... B25H 3/003 206/372
7,552,950 B2 6/2009 Scheffy et al.
7,784,887 B2 * 8/2010 Grela ..... B25H 3/028 312/218
D636,615 S 4/2011 Grela
7,946,663 B2 * 5/2011 Holcomb ..... E05B 65/46 312/217
D649,377 S * 11/2011 Manalang ..... D6/670
8,056,943 B2 11/2011 Scheffy et al.
8,056,995 B2 11/2011 Grela et al.
8,084,992 B2 * 12/2011 Scheffy ..... B25H 3/02 312/223.1
8,157,337 B2 4/2012 Manalang
D660,462 S * 5/2012 Chen ..... D25/119
8,240,786 B2 * 8/2012 Daino ..... A47B 47/02 292/128
D678,694 S 3/2013 Grela
8,944,537 B1 * 2/2015 Manalang ..... B25H 3/028 312/319.2
9,010,886 B2 * 4/2015 Grela ..... B25H 3/00 312/323
9,181,731 B2 * 11/2015 Grela ..... A47B 81/00
2003/0213100 A1 * 11/2003 Brain ..... E05D 15/30 16/361
2004/0046488 A1 * 3/2004 Hogan ..... E05D 15/58 312/322
2004/0100171 A1 * 5/2004 Brown ..... E05D 15/58 312/322
2005/0204646 A1 * 9/2005 Tupper ..... E05B 65/462 52/36.5
2007/0159037 A1 * 7/2007 Hoffman ..... E05D 15/58 312/322
2008/0150407 A1 * 6/2008 Mehmen ..... E05B 65/46 312/332.1
2008/0276667 A1 * 11/2008 Scheffy ..... E05B 65/46 70/85
2008/0278046 A1 11/2008 Scheffy
2010/0072716 A1 * 3/2010 Grela ..... B25H 3/021 280/47.35
2010/0270898 A1 * 10/2010 Haab ..... E05D 15/0634 312/323
2010/0276317 A1 11/2010 Grela
2010/0282629 A1 * 11/2010 Grela ..... A47B 47/02 206/372
2010/0314978 A1 * 12/2010 Manalang ..... B25H 3/021 312/243
2011/0121701 A1 * 5/2011 Chang ..... E05B 7/00 312/332.1
2011/0309730 A1 * 12/2011 Retchloff ..... E05B 65/46 312/332.1
2013/0232878 A1 * 9/2013 Bortoluzzi ..... E05D 15/58 49/252
2015/0008811 A1 * 1/2015 Ishii ..... E05D 15/58 312/322

OTHER PUBLICATIONS

United States Trademark Registration No. 3,930,484.
Matco Tools Catalog at least as early as Oct. 29, 2014.
Notification of First Office Action (Including Search Report)—The State Intellectual Property Office of The People's Republic of China (dated Mar. 21, 2013)—App No. 201080026995.9.

(56) References Cited

OTHER PUBLICATIONS

European Search Report—dated Jun. 25, 2014—Application No. 10166026.4-1701/2263836.
European Search Report—dated Jun. 18, 2014—Application No. EP-10-16-6026.
Notice of References cited—U.S. Appl. No. 13/998,368, filed Oct. 25, 2013.

* cited by examiner

CABINET

GENERAL BACKGROUND

Field of the Invention

The present invention generally relates to a cabinet and more particularly to a storage cabinet having at least one door which is selectively movable between various positions including a first position in which the at least one door resides within the cabinet, a second position in which the at least one door resides outside of the cabinet, and various selectable third positions in which the at least one door selectively articulates outside of the at least one cabinet along an arc or angle with respect to the interior of the cabinet.

Background of the Invention

Cabinets are generally used to store various diverse articles or items and allow for the selectively stored articles or items to be later removed. Typically, such cabinets have at least one door which selectively allows access to the articles or items which are stored within the cabinet and which further is movable to a closed position in which the interior of the cabinet is closed in a manner which allows the received articles to be hidden from view and which provides an aesthetically pleasing overall appearance.

While these prior cabinets do allow for the selective storage of various articles or items, and for a pleasing overall appearance, the at least one door requires significant space around the cabinet with which to "swing" or selectively and "sweepingly" articulate about an arc with respect to the interior of the cabinet.

The extended at least one door is a significant drawback, especially when it is desired to utilize the cabinet in a very small area in which workers and other individuals traverse, reside, and/or perform some task requiring continual access to the interior of the storage cabinet. Particularly, the at least one door must be and must remain extended away from the cabinet to allow individuals to have continual access to the various articles or items contained in the cabinet. The extended at least one door becomes both a safety hazard (e.g., workers may trip or fall over the extended at least one door and/or hit their respective heads or other parts of their respective body) and becomes an annoying impediment to completing the required work in the relatively small area that the cabinet may reside within. Requiring the workers or other individuals to continually open and close the at least one cabinet door each time an item or article is taken or removed from the cabinet is cumbersome, annoying, and undesirably decreases the overall efficiency of the work which is being done by the use of the contained articles or items.

There is therefore a need for a new and improved cabinet which overcomes some or all of the limitations and drawbacks which have been described above and the present inventions provide such a cabinet.

SUMMARY OF THE INVENTION

It is a first non-limiting object of the present invention to provide a new and improved cabinet which overcomes the various drawbacks associated with prior cabinets, such as those which have been previously delineated.

It is a second non-limiting object of the present invention to provide a cabinet having at least one drawer which may be selectively stored within the cabinet.

It is a third non-limiting object of the present inventions to provide a cabinet having at least one shelf which be selectively placed within and/or stored within the cabinet.

According to a first non-limiting aspect of the present invention, a cabinet is provided having at least one door which is selectively movable from a first stored position within the cabinet to a second position outside of the cabinet and wherein the at least one door when is said second position is selectively movable along an arc.

According to a second non-limiting aspect of the present invention, a cabinet is provided having a body containing a generally hollow interior cavity; a frame assembly which is operatively deployed within the interior cavity; and at least one door which is coupled to the frame assembly and wherein the frame assembly allows the at least one door to be movable from a first position in which the at least one door overlays the generally hollow interior cavity to a second position in which the at least one door pivots away from the generally hollow interior cavity to a third position in which said at least one door removably resides within the generally hollow interior cavity.

According to a third non-limiting aspect of the present invention, a cabinet is provided having a generally hollow body; a frame assembly which is operatively deployed within the generally hollow body and which comprises a pair of opposed rails; a hinge assembly which is movably and axially deployed upon the pair of opposed rails; and an equalizer bar assembly which is coupled to the hinge assembly and to the generally hollow body and which is movable from a first collapsed position to a second extended position; and wherein the cabinet further includes at least one door which is coupled to the hinge assembly and wherein the at least one door is selectively movable from a first position outside of the generally hollow body when the equalizer bar assembly is in the second extended position to a second position within the generally hollow body when the equalizer bar assembly is in the first collapsed position and wherein the at least one door is selectively and arcuately movable about the hinge assembly when the at least one door is outside of the generally hollow body.

These and other aspects, features, and advantages of the present invention will become apparent from a reading of the following detailed description of the preferred embodiment of the invention, including but not limited to the subjoined claims, and by reference to the following drawings.

BRIEF DESCRIPTION OF THE DRAWINGS

FIG. 10 is a view of the cabinet which is shown in FIG. 1 and taken in the direction of arrow "1" wherein FIG. 1 shows arrow "10";

DETAILED DESCRIPTION OF THE PREFERRED EMBODIMENT OF THE INVENTIONS

Figure 1:
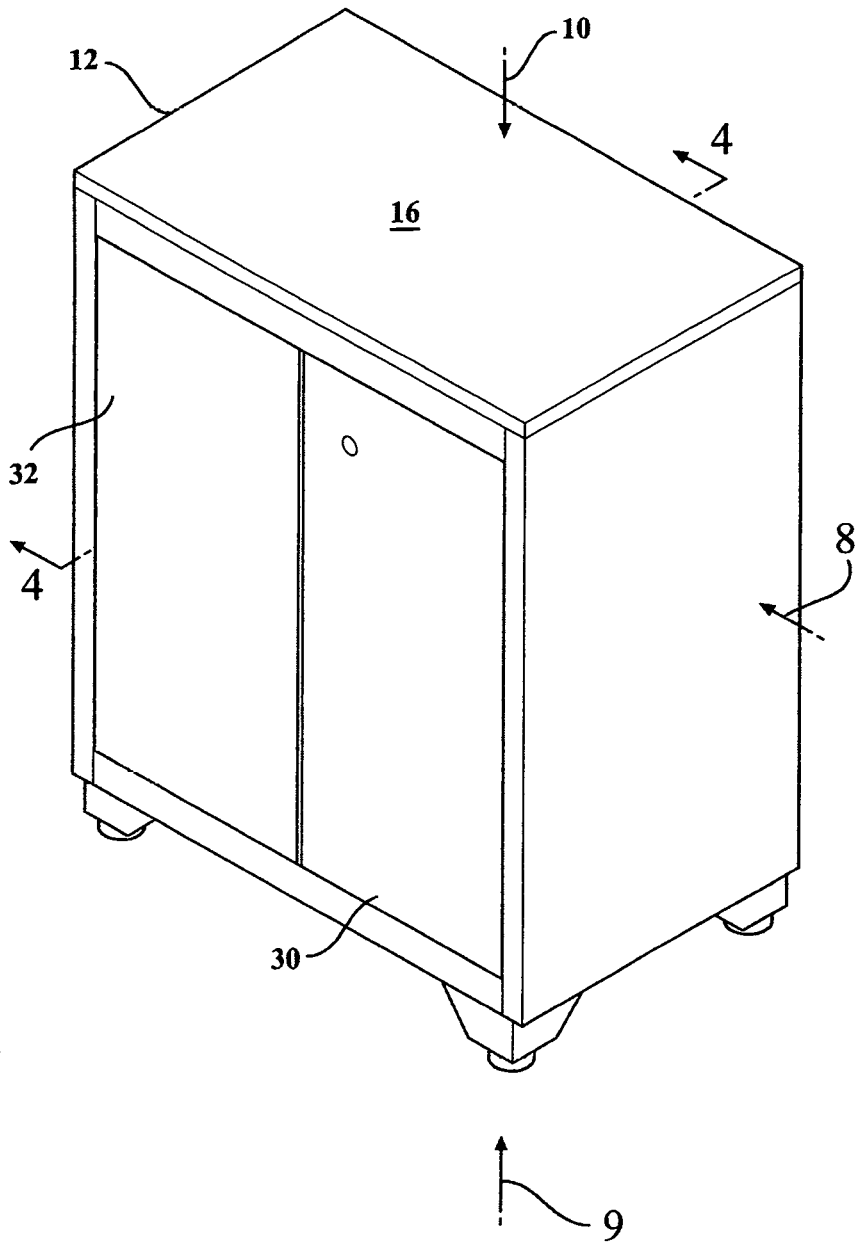
FIG. 1 is perspective view of a cabinet which is made in accordance with the teachings of the preferred embodiment of the inventions and showing both doors in a closed position.
Figure 2:
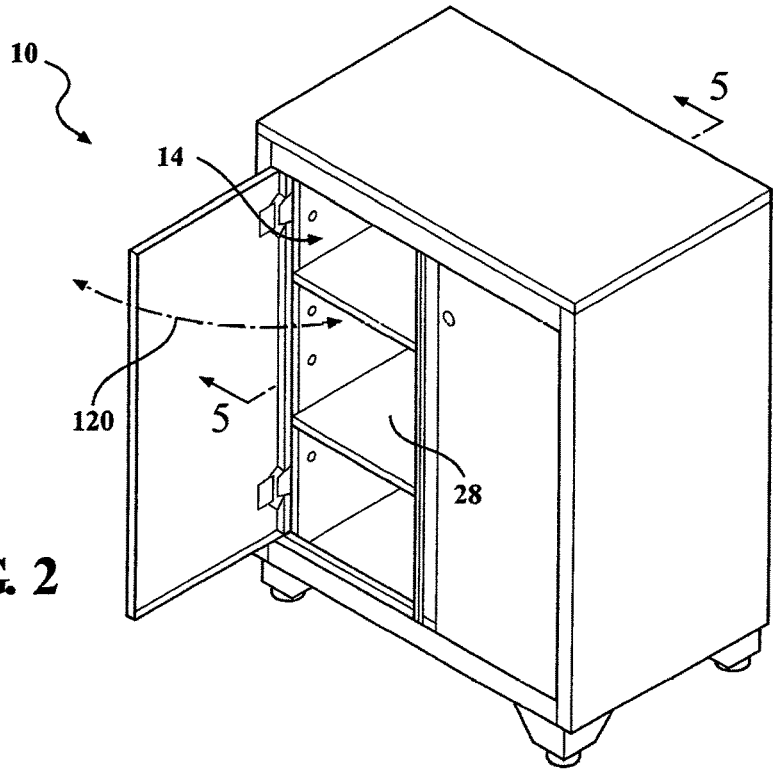
FIG. 2 is a view which is similar to that of FIG. 1, but illustrating the open position of one of the two doors.
Figure 3:
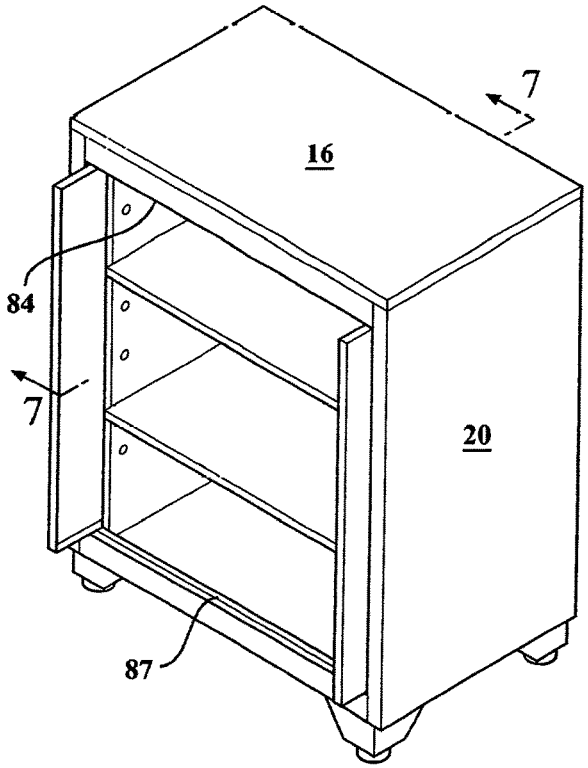
FIG. 3 is a view which is similar to that of FIG. 1, but illustrating the stored position of both doors.
Figure 5:
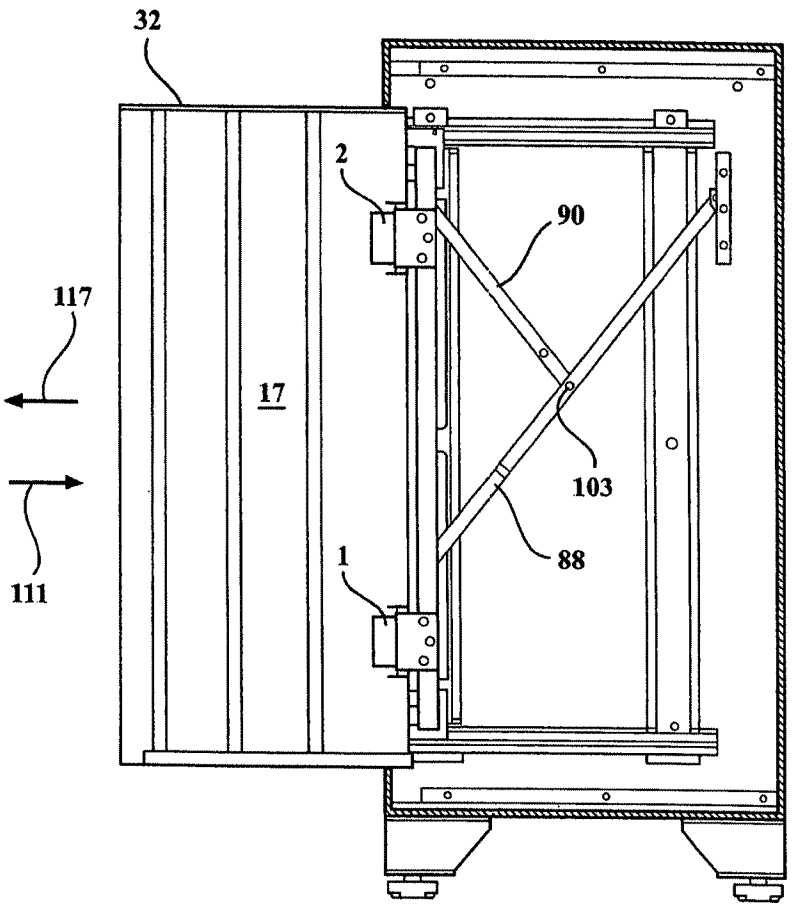
FIG. 5 is a sectional view taken along view line 5-5 of the cabinet which is shown in FIG. 2.
Figure 4:
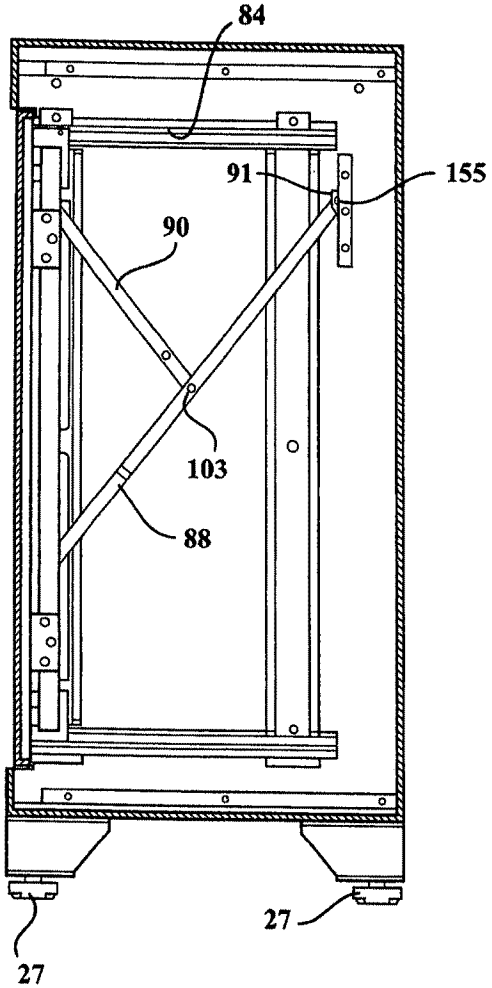
FIG. 4 is a sectional view taken along view line 4-4 of the cabinet which is shown in FIG. 1.
Figure 7:
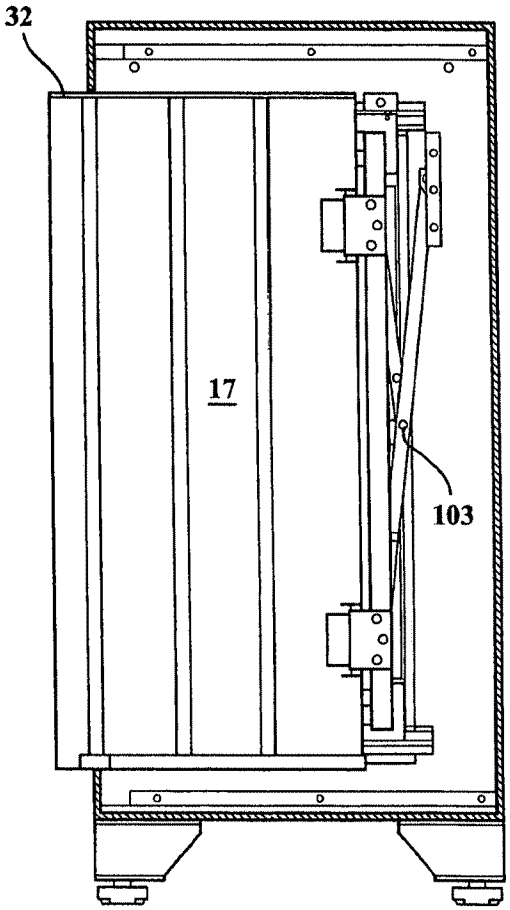
FIG. 7 is a view which is substantially similar to that which is shown in FIG. 6 but showing the door in a fully stored position and is further a sectional view taken along view line 7-7 of the cabinet which is shown in FIG. 3.
Figure 6:
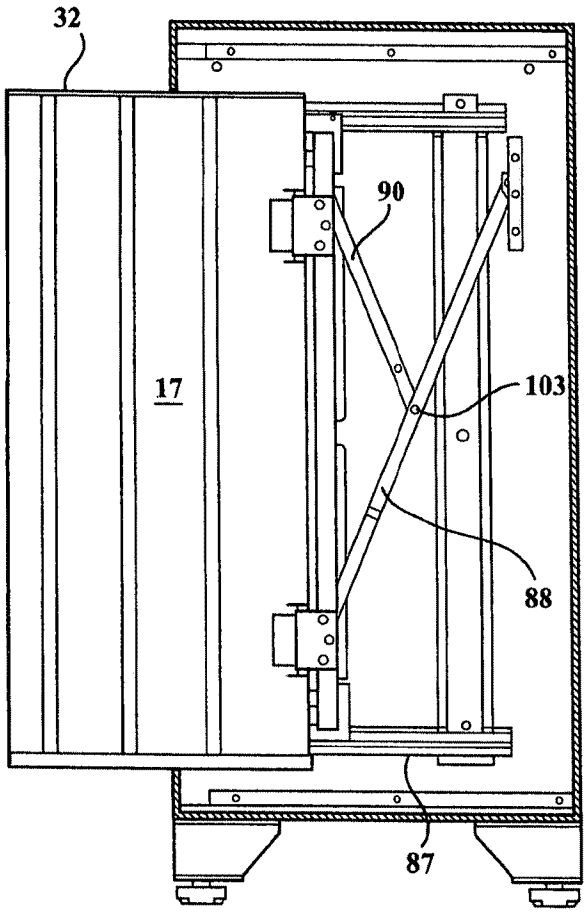
FIG. 6 is a view similar to that which is shown in FIG. 5 but further illustrating the position of the door in a halfway stored position.
Figure 8:
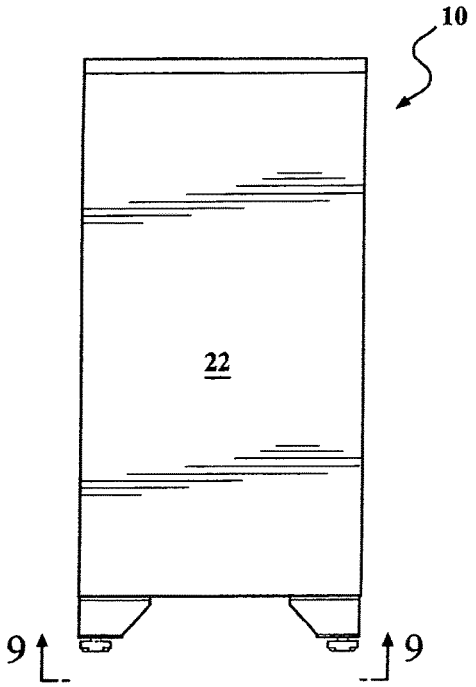
FIG. 8 is a view of the cabinet 10 which is shown in FIG. 1 and taken in the direction of arrow "8"
Figure 9:
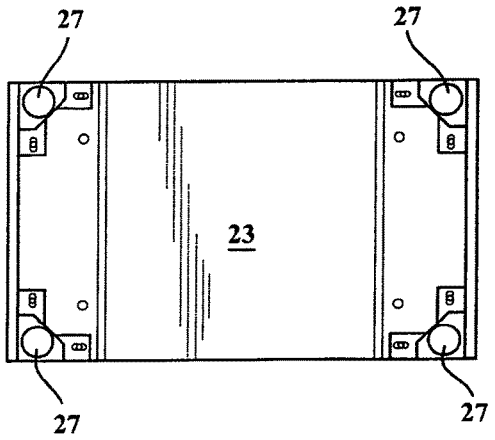
FIG. 9 is a view of the cabinet which is shown in FIG. 1 and taken in the direction of arrow "9"
Figure 10:
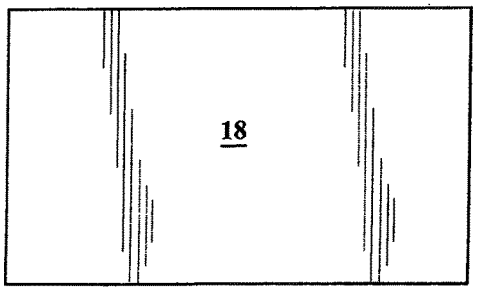
Figure 11:
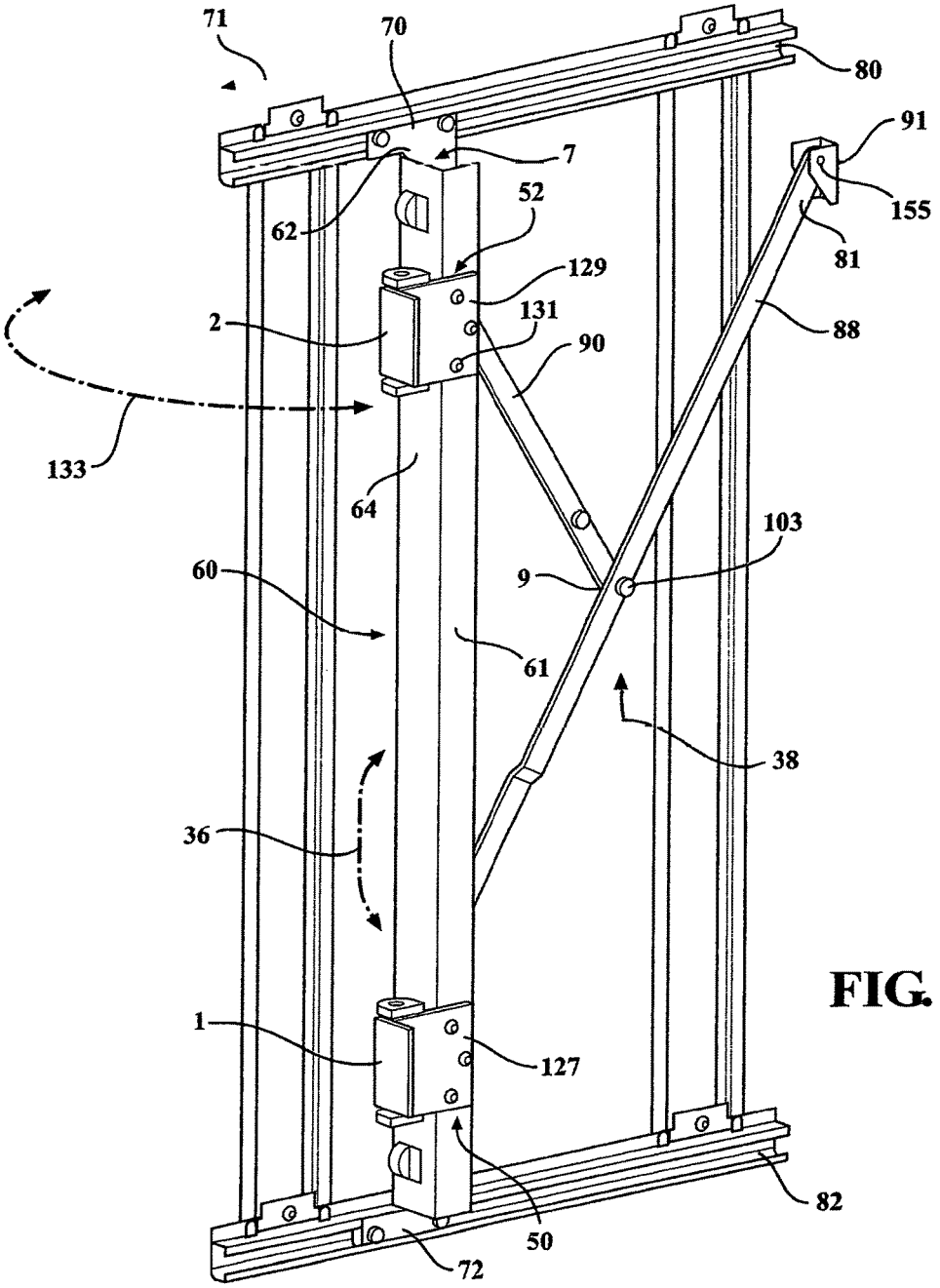
FIG. 11 is a partial perspective view of a portion of the frame assembly which is shown in FIG. 5.
Figure 12:
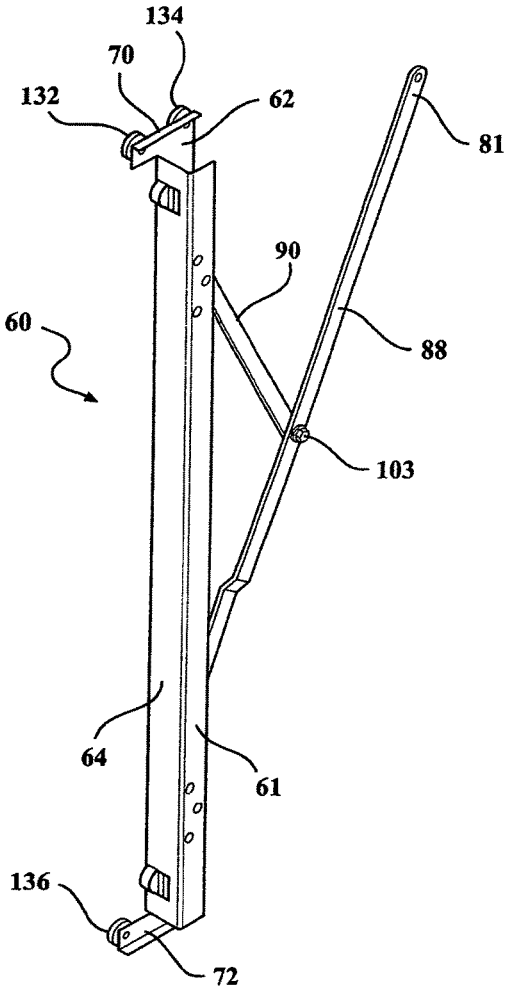
FIG. 12 is an unassembled perspective view of a portion of the frame assembly which is shown in FIGS. 4-7.
Figure 13:
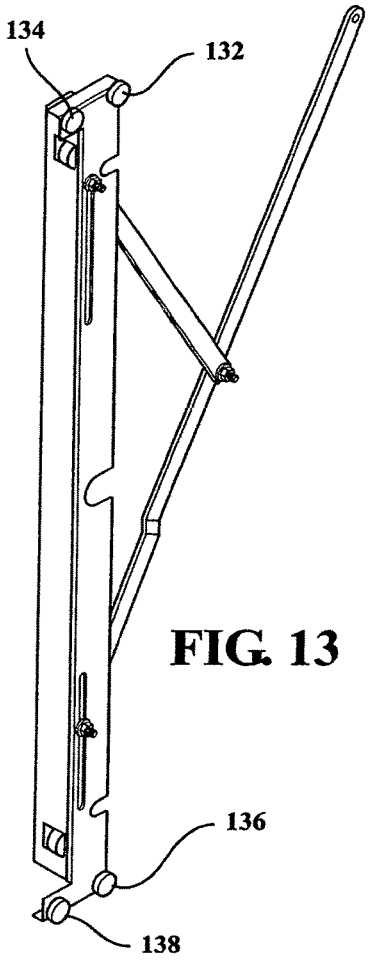
FIG. 13 is an unassembled perspective view of the portion of the frame assembly which is shown in FIG. 20 and which is operatively attached to door 30.
Figure 14:
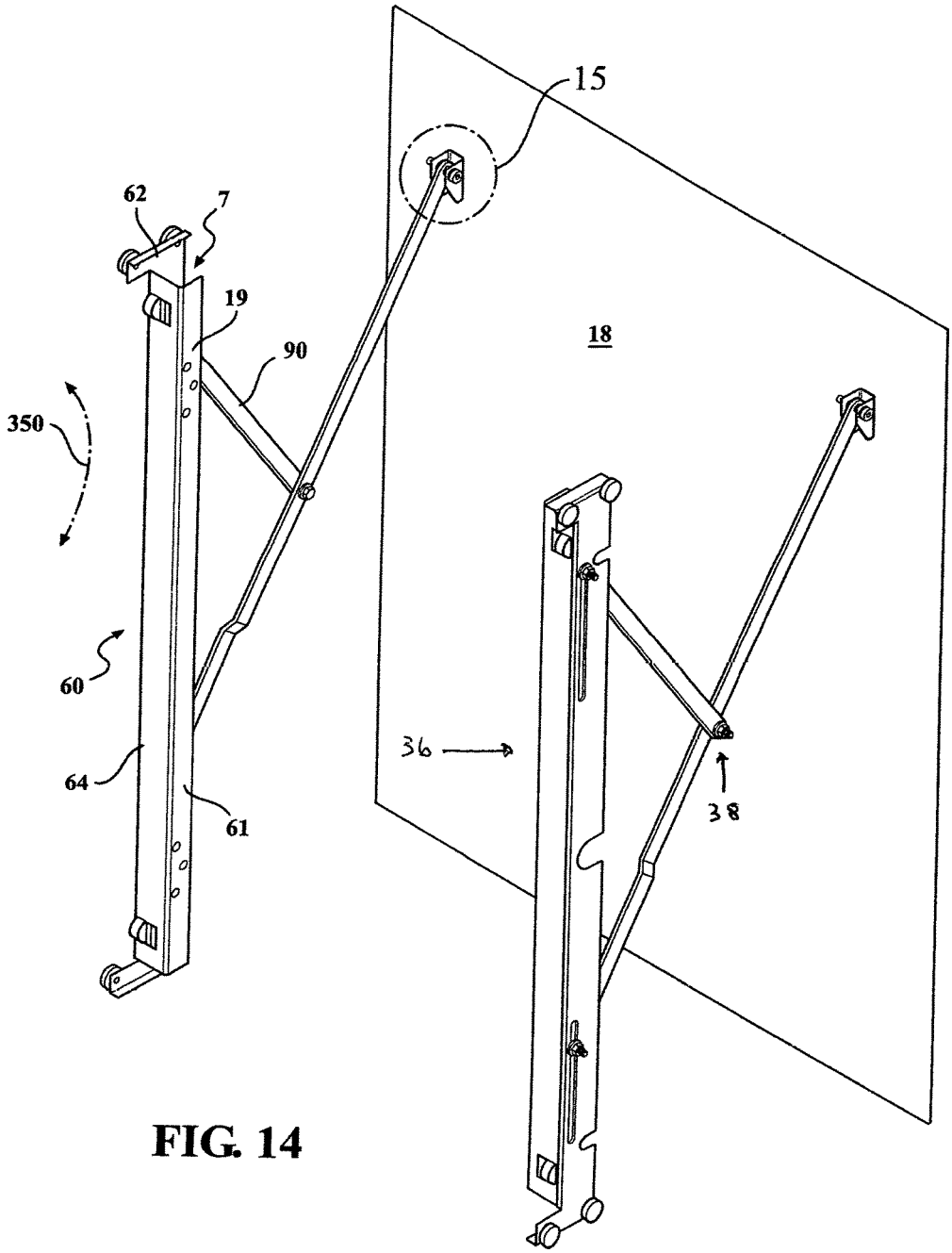
FIG. 14 is a partial unassembled view of the frame assembly which is operatively deployed within and which forms an integral part of the cabinet 10.
Figure 15:
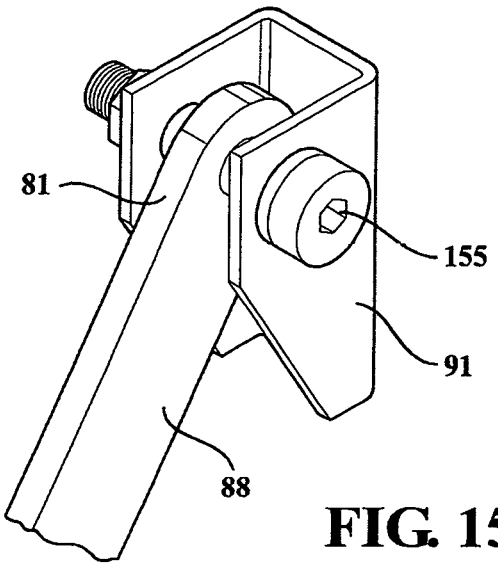
FIG. 15 is an exploded view of the portion "15" which is shown in FIG. 14.
Figure 17:
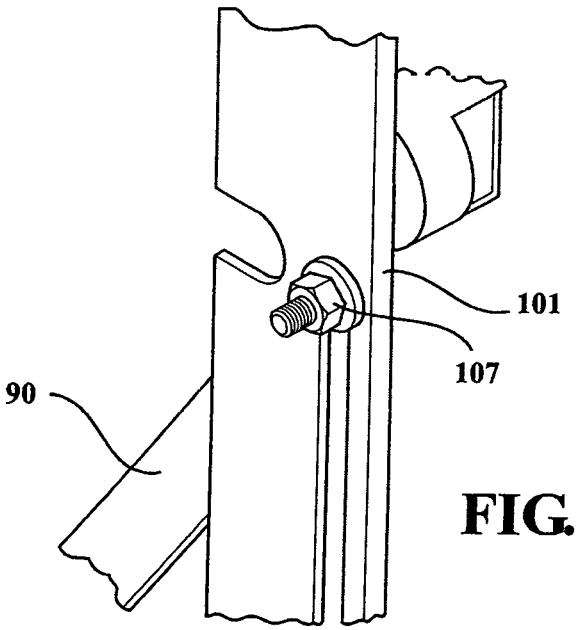
FIG. 17 is an exploded view of the portion "17" which is shown in FIG. 16.
Figure 16:
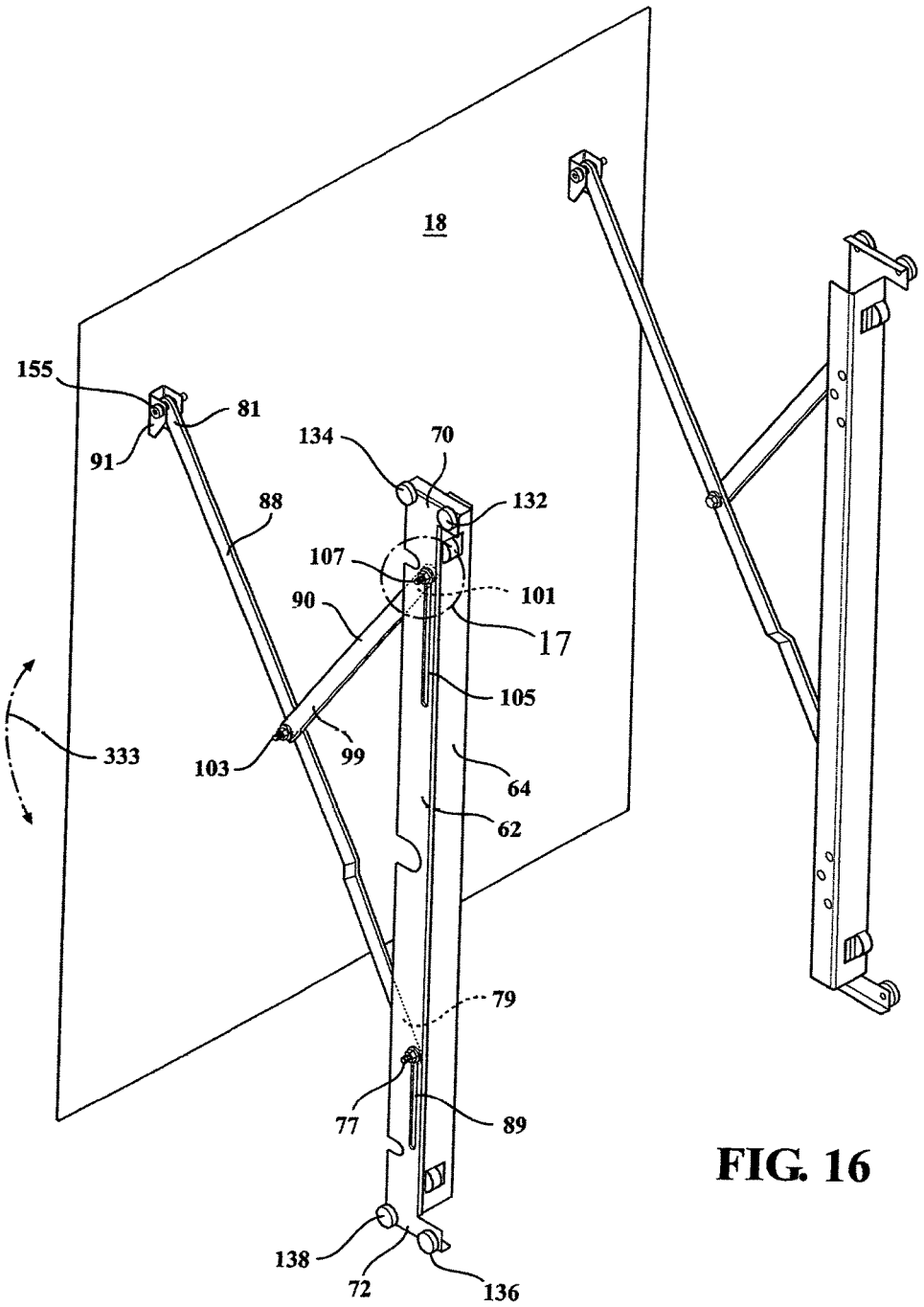
FIG. 16 is a partial unassembled perspective view of a portion of the cabinet which is shown in FIG. 14.

Referring now to FIGS. 1-17 and 20, there is shown a cabinet 10 which is made in accordance with the teachings of the preferred embodiment of the various inventions.

Particularly, cabinet 10 includes a body 12 which defines or provides a generally hollow interior storage cavity 14 into which various articles or items may be selectively and removably stored. The body 12 includes a generally flat top member 16 which is coupled to a generally flat back member 18 and which is further coupled to a pair of substantially identical, opposed, and generally flat side members 20, 22 and to a generally flat bottom member 23. A plurality of feet, each having an adjustable height, 27 may be operatively deployed and coupled upon the generally flat bottom member 23 to permit the cabinet 10 to be selectively deployed in a stable manner at a certain location. However, it should be realized that feet 27 may not be used and instead, wheels may be used or a combination of legs and wheels may be used to allow the cabinet to be selectively moved about and selectively deployed in a stable manner at a certain location. Moreover, the legs may be of the type which are height adjustable. Feet 27 may even be replaced by conventional caster and wheel assemblies (e.g., each such assembly includes the combination of a caster and a wheel).

It is these coupled members 16, 18, 20, 22, and 23 which define or provide the generally hollow storage cavity 14 and inside this generally hollow storage cavity 14 may reside at least one generally flat shelf 28 which may be coupled to side members 20, 22. Nothing in this description is meant to limit the cabinet 10 to a particular size, shape, or geometric configuration and the various inventions have wide applicability to a variety of diverse sizes, shapes, and geometric configurations. Cabinet 10 is but one non-limiting example of a cabinet which may include the various inventions set forth herein. Moreover, the cabinet 10 may be constructed from metal, wood, a composite material, or substantially any other desired material, including plastic. Further, the members 16, 18, 20, 22, and 23 may be coupled by use of a welded connection, by standard mechanical fasteners, by a combination of both welded and mechanical fastening type connections, or by substantially any other desired coupling technique or strategy. Moreover, one or a plurality of shelves, such as shelf 28, may be operatively deployed within the storage compartment 14 and nothing in this description limits the cabinet 10 to a particular number or type of shelf. Alternatively, no shelves may be utilized and the cabinet 10 may function as a locker. Shelf, such as shelf 28, may also be retractably and movably coupled to the side members 20, 22 by, for example, having its opposed ends reside in opposed and substantially identical grooves which are respectively formed in the respective surface of each member 20, 22 which communicates with or which is closest to the interior cavity 14. The shelf 28 may also be other than flat. Drawers can also be added in combination with or without shelves, as desired.

Cabinet 10 further includes opposed and substantially similar and generally flat doors 30, 32 which are each respectively coupled to a substantially identical hinge assembly 36 and to a substantially identical equalizer assembly 38. The following description generally centers upon the operation and movement structure associated with door 32, but it should be realized that the operation and the co-operative combination of the respective hinge assembly and equalizer bar assembly associated with door 30 is the same as described with respect to door 32. This co-operative combination of a hinge and an equalizer bar assembly may be referred to as a "structure" or "frame assembly" later in this description. Moreover, it should further be realized that nothing in this description is meant to limit the use of a certain number of doors and that cabinet 10 may have one, three, or more doors and that the two doors 30, 32 are shown for illustration purposes only. Moreover, the utilized door or doors may be of substantially any desired shape, size, or geometric configuration.

Hinge assembly 36 includes a pair of substantially identical and opposed hinges 50, 52 which have respective first end portions 1,2 which are respectively coupled to opposed longitudinal ends of the back surface 17 of door 32 (by use of a welded connection or a mechanical fastener type of connection or a combination of each). Each hinge 50, 52 also respectively includes a respective second surface 127, 129 which is respectively and movably coupled to receptive first end portions 1,2 such that respective end portions 1,2 may selectively rotate in along arc 133 with respect to respective portions 127, 129 when the door 32 is outside of the formed storage cavity 14. The coupling of respective portions 1,2 to respective portions 127, 129 may be achieved by a spring assembly or another type of rotational assembly commonly found within hinges.

Hinge assembly 36 includes a bar assembly 60 and the bar assembly 60 further includes a flat body surface portion 61, which is coupled to each hinge surface 127, 129 (by pins, screws, or other type of mechanical fasteners 131) and the bar assembly forms or includes a trench 7 which is longitudinally coextensive to the back surface 17 of the door 32. The bar assembly 60 also includes integrally formed and opposed flat body surface portions 62, 64. In one non-limiting embodiment, surfaces 62, 61 are parallel, longitudinally coextensive, and are each integrally formed with the third surface 64 of the bar assembly 60. Both surfaces 61, 62 orthogonally project from the body surface 64, but surface 62 is wider than surface 61 in that surface 62 extends further in the direction 111 (into the interior of the formed cavity 14 and toward the back surface 18) than does surface 61 from the body portion 64. The flat surface portion 61 is coupled (at respective and longitudinally opposed ends) to the hinges 52, 50 by use of a welded connection, a mechanical fastener type connection, or a combination and both, as described earlier. Moreover, flat surface portion 62 includes, at opposed longitudinal ends, integrally formed and substantially identical flat flange portions 70,72 which are each respectively parallel to flat surface 61 and which project away from portion 62 in the same direction 71. As shown best in FIGS. 4-7, the bar assembly 60, in one non-limiting embodiment of the invention, is longitudinally coextensive to the back member 18.

Further, the hinge assembly 36 includes a plurality of wheels 132, 134, 136, and 138. In one non-limiting embodiment of the invention, wheels 132, 134 are operatively deployed upon the flat flange portion 70 while wheels 136, 138 are operatively deployed upon the flat flange portion 72. Further, substantially identical channels 89, 105 are formed upon opposed longitudinal ends of flat portion 62. Particularly, channel 89 resides above (but in close proximity to portion 72) and in a direction toward the portion 70, while channel 105 resides below (but in close proximity to portion 70) and in a direction toward the portion 72.

Equalizer assembly 38 includes a pair of opposed and substantially identical rails or tracks 80, 82 which are respectively deployed upon and are linearly coextensive to the interior surface 84 of the top member 16 and interior surface 87 of the bottom member 23, which each project into the generally hollow interior cavity 14, and which respectively and moveably receive wheels pairs 132, 134; and 136,138. Particularly, the wheel pairs 132, 134; and 136, 138 selectively, reciprocally, and respectively move within and upon the members 80, 82 in the directions 111, 117 and these wheel pairs 132,134; and 136,138 respectively and frictionally fit within these respective channels 80, 82 such that they move in the foregoing reciprocal and selective manner but do not fall out from the respective channels 80, 82.

Further, equalizer assembly 38 also includes two pivot members 88, 90 which are substantially identical in shape and cross sectional area, but are dissimilar in length. Particularly, in one non-limiting embodiment, member 88 is longer than member 90. Particularly, pivot member 88 has a first end 79 which is coupled to and which moves selectively and reciprocally along and within the channel 89 formed within the flat surface 62, and a second opposed end 81 which is coupled (such as by a pin assembly 155) to a bracket member 91. As shown, the bracket member 91 is generally "U"-shaped and is fixed or coupled (such as by use of a welded connection or another type of mechanical connection) to the interior surface of the back member 18. The bracket member 91 may alternatively be coupled to any other portion or surface of the cabinet 10. The term "interior surface" means the surface of the back member 18 which communicates with the formed interior cavity 14 The pin assembly 155 allows the end 81 to selectively move along arc 333. Moreover, the coupling of end 79 to and within the channel 89 is, in one non-limiting embodiment, accomplished by a pin 77 which movably resides within and through the channel 89 and which is coupled to the end 79, and which may traverse the channel 89. Other coupling strategies may be employed in other non-limiting embodiments of the invention. It should be realized, that channel 89 is parallel to the back surface 18.

Pivot member 90 has a first end 99 which is coupled to the middle of pivot member 88, by a pin 103, and a second opposed end 101 which is pivotally coupled to and through the portions 61 and 62 and above (but not within) the channel 105 by a pin 107. In one non-limiting embodiment of the invention, channels 89 and 105 are substantially identical and lie along the same longitudinal axis of symmetry. The pins 103 and 107 allow the member 90 to selectively move along arc 350.

In operation, the door 32 may be selectively stored within the generally hollow cavity 14 by placing the door 32 in a position which is parallel to the side wall 20 (when the door 32 is outside of the storage cavity 14) and then by pushing the door 32 in a direction 111. This movement, in the direction 111, causes the pivot members 88 and 90 to "straighten out" or move in that direction 111 until the pivot members 88, 90 are substantially parallel to the back member 18. This movement, in the direction 111, also causes the bar 60 to move toward the back member 18 since the wheel pairs 132, 134 and 136, 138 are forcibly moved toward the back member 18. In the foregoing manner, the door 32 is made to selectively and removably reside within the generally hollow storage cavity 14. In one non-limiting embodiment of the various inventions, the door 32 is parallel to each of the side members 20, 22 when selectively placed within the storage cavity 14.

When it is desired to move the stored door 32 outside of the generally hollow storage cavity 14, the door 32 is pulled in the direction 117 and the wheel pairs 132,134 and 136, 138 respectively move along the tracks or member 80,82 in the direction 117, while the respective ends 81, 79 of the pivot members 88 and the respective ends 99, 101 of the pivot member 90 are moved away from the back member 18, thereby allowing the door 32 to be selectively and removably placed outside of the generally hollow storage cavity 14. It should be further appreciated, that the pivot members 88, 90 also function to structurally support the door 32 and reduce the likelihood of having the door 32 "sag" or begin to drop toward the bottom member 23 while maintaining its connection to the hinges 50, 52.

Once outside of the cavity 14, the door 32 may articulate along the arc 120 by use of the opposed hinges 50, 52 and may be selectively and removably placed in the closed position in which the door 32 is substantially parallel to the generally flat back member 18, or in various other selective positions along the movement arc 120. It should be appreciated that the use of two channels 89, 105 allows a single member 60 to be used for each door 30, 32.

Thusly, it should be appreciated that fixed pivoting members as well as traversing pivoting members are pertinent components describing the function of the equalizer assembly 38. It is important to note that the top portion 81 of equalizer bar 88 or the portion of equalizer bar 88 that uses bracket 155 to attach to the top, side, or back of the cabinet 10, is a fixed pivoting component and that the top portion 101 of equalizer bar 90 is a fixed pivoting component and attaches above channel 105. It does not traverse channel 105 (in the most preferred embodiment of the inventions). Additionally, the lower end 99 of member 90 also attaches as a fixed pivoting component to about the middle of equalizer bar 88.

Thusly, it should be further appreciated that the whole equalizer assembly 38 (in the most preferred embodiment of the invention) has a portion which traverses a channel 89 and allows the in and out motion of the doors 30, 32 (e.g., toward and away from the internal storage compartment 14). When the at least one door 32 is in a fully open position (away from the internal storage cavity 14) and is therefore completely outside of the body of the cabinet 10, portion 79 resides in the top most portion of the channel 89 or the portion or the channel 89 which is located nearer to the middle of the equalizer bar 88 and away from the bottom member 23. As the at least one door 32 is pushed into the closed/stored position within the storage cavity 14, the portion 79 traverses down or toward the farthest end of the channel 89. When the at least one door 32 is in a fully stored position (within the cavity 14), the portion 79 rests at the bottom of the channel 89 (i.e., the portion of the channel 89 which is closes to the bottom member 23). As the at least one door 32 is pulled out into the fully open position, the portion 79 traverses back up the channel 89 to allow the at least one door 32 to be selectively extended outside of the cabinet body 14.

As is perhaps best shown in FIGS. 13, 14,16, and 20, door 30 is coupled to a frame assembly which is substantially identical to the frame assembly which has been previously discussed with respect to door 32 and which includes an equalizer assembly 38 which is substantially identical to the previously described equalizer assembly 38 associated with door 32, and a hinge assembly 36 which is substantially identical to the previously described hinge assembly 36 which is associated with door 32 and which includes a pair of hinges which are substantially identical to hinges 50,52. Assemblies 36, 38 of door 30 cooperatively provide the very same functionality as the frame assembly associated with door 32 provides and which has been previously described above. It should therefore be realized that each door 30, 32 moves in an independent manner (e.g, the selective articulation of door 30 does not cause any articulation of door 32 and the selective articulation of door 32 does not cause any articulation of door 30 and each door 30, 32 may be selectively articulated and has no respective effect on the articulation capability of the other door 30, 32).

Figure 18:
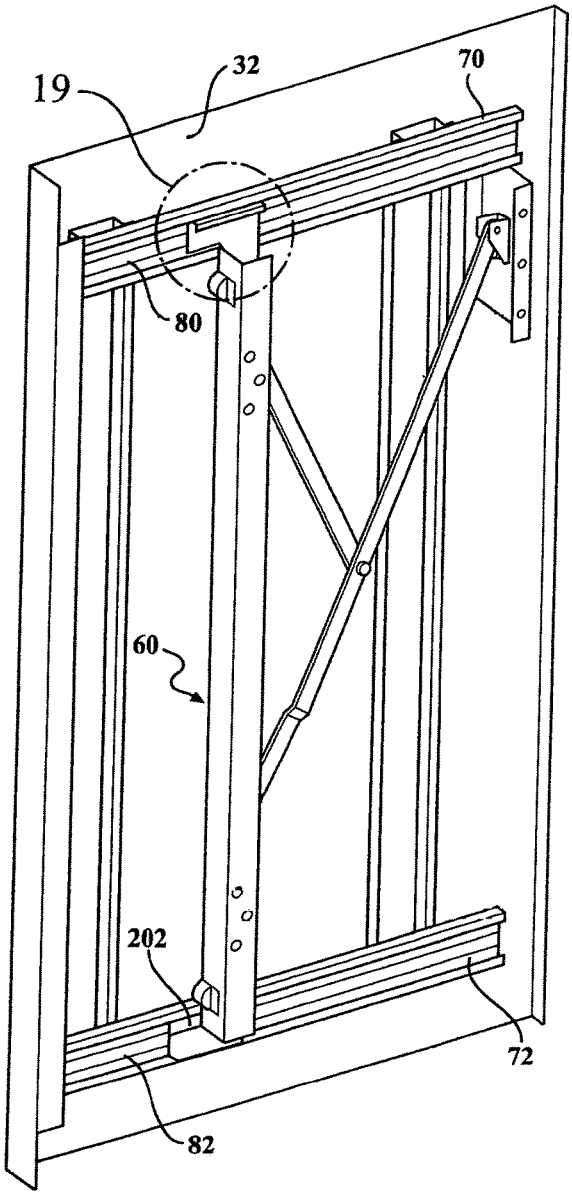
FIG. 18 is a view which is similar to that shown in FIG. 11 but made in accordance with yet another non-limiting and alternate embodiment of the invention.
Figure 19:
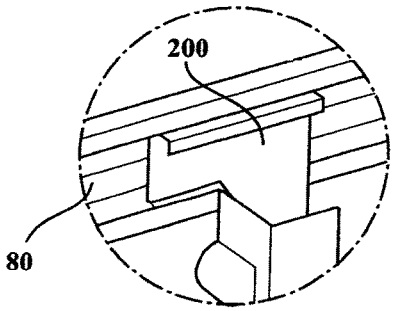
FIG. 19 is a partial exploded view of the portion of the assembly shown in FIG. 18 which is denoted as "19" in that FIG. 19.
Figure 20:
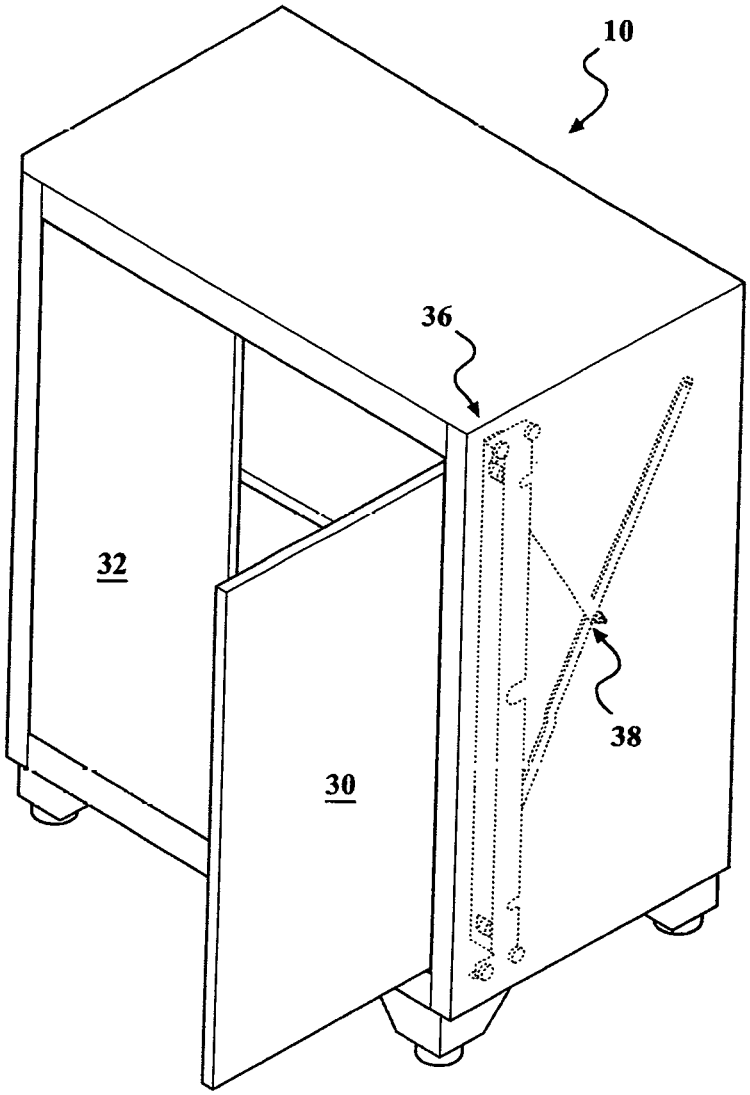
FIG. 20 is a perspective view of the cabinet of FIG. 1 but further showing the portion of the frame assembly which is operatively coupled to the door 30.

Additionally, as is perhaps best shown in FIGS. 18 and 19, the previously described plurality of wheels 132-134 may be replaced by a slide portion 200 which may be attached to or is integrally formed with portion 70, and wheels 136-138 may similarly be replaced by a slide portion 202 which is substantially identical to slide portion 200 and which may be integrally formed with or attached to portion 72. Particularly, slide portions 200, 202 (which are generally square or rectangular in shape), respectively and frictionally but movably fit within the tracks 80, 82, thereby allowing the at least one door 32 to be selectively moved into and out of the cavity 14 in the manner described. The slide portions 200, 202 may be replaced by conventional ball bearings or any other device or apparatus or assembly which allows the bar assembly 60 (and the attached at least one door 32) to selectively and reciprocally moved into and out of the cavity 14 in the manner indicated and described. The slide portions 200, 202 may be constructed out of steel, aluminum, plastic, wood, a composite material, or any other desired material.

It is to be understood that the present invention is not limited to the exact construction or method which has been illustrated and delineated above, but that various modifications may be made without departing from the spirit and the scope of the following claims. It should further be realized that the cabinet 10 may also, in other non-limiting embodiments, include no drawers, and may include no shelves at all, such as shelf 28.

What is claimed is:

1. A cabinet comprising a hollow body including a top member; a back member; a bottom member; and a pair of side members which cooperatively form a hollow interior cavity; a pair of rails which are in a mutually parallel relationship and wherein a first of said pair of rails is coupled to a first of said pair of side members and wherein a second of said pair of rails is coupled to said first of said pair of side members; a bar having first, second, and third flat body surfaces which cooperatively form a trench; a first pair of wheels which are attached to a first end of said first flat body surface and which movably reside within a first of said pair of rails; a second pair of wheels which are attached to a second end of said first flat body surface and which movably reside within a second of said pair of rails, whereby said first and said second pair of wheels cooperatively allow said bar to selectively and reciprocally move along and within said pair of rails and wherein said first flat body surface includes a channel proximate to said first pair of wheels and a second channel proximate to said second pair of wheels; a first hinge which is coupled to a first end of said second body flat body surface; a second hinge which is coupled to a second end of said second flat body surface; a first pivot member having a first end which is movably disposed within said second channel and a second end which is pivotally coupled to said back member; a second pivot member having a first end which is pivotally coupled to said first pivot member and a second end which is coupled to said first flat body surface; and a door which is coupled to said first and to said second hinges, whereby said first and second pivot members cooperate with said pair of rails and said first and second pairs of wheels to selectively allow said door to be selectively and wholly placed within said hollow interior cavity and to be movable from said position within said hollow interior cavity to a position outside of said hollow internal cavity, and wherein said first and second hinges cooperate to allow said door to move in an arc about said body when said door is selectively placed outside of said hollow internal cavity.

2. The cabinet of claim 1 further comprising a shelf which is deployed within said hollow interior cavity.

3. The cabinet of claim 1 further comprising a second door.

4. The cabinet of claim 1 wherein said first and said second rails are substantially identical and linearly coextensive.

5. The cabinet of claim 1 wherein said second pivot member is movably coupled within said second channel.

6. The cabinet of claim 1 wherein said first and second channels are substantially similar.

7. A cabinet comprising a hollow body including a top member; a back member; a bottom member; and a pair of side members which cooperatively form a hollow interior cavity; a pair of rails which are in a mutually parallel relationship and wherein a first of said pair of rails is coupled to a first of said pair of side members and wherein a second of said pair of rails is coupled to said first of said pair of side members; a bar having first, second, and third flat body surfaces which cooperatively form a trench; a first slide which is formed upon a first end of said first flat body surface and which frictionally and movably reside within a first of said pair of rails; a second slide which is formed upon a second end of said first flat body surface and which frictionally and movably reside within a second of said pair of rails, whereby said first and said second slides cooperatively allow said bar to selectively and reciprocally move along and within said pair of rails and wherein said first flat body surface includes a channel proximate to said first slide and a second channel proximate to said second slide; a first hinge which is coupled to a first end of said second body flat body surface; a second hinge which is coupled to a second end of said second flat body surface; a first pivot member having a first end which is movably disposed within said second channel and a second end which is pivotally coupled to said back member; a second pivot member having a first end which is pivotally coupled to said first pivot member and a second end which is coupled to said first flat body surface; and a door which is coupled to said first and to said second hinges, whereby said first and second pivot members cooperate with said pair of rails and said first and second slides to selectively allow said door to be selectively and wholly placed within said hollow interior cavity and to be movable from said position within said hollow interior cavity to a position outside of said hollow internal cavity, and wherein said first and second hinges cooperate to allow said door to move in an arc about said body when said door is selectively placed outside of said hollow internal cavity.

8. A cabinet comprising a hollow body including a top member; a back member; a bottom member; and a pair of side members which cooperatively form a hollow interior cavity; a pair of rails which are in a mutually parallel relationship and wherein a first of said pair of rails is coupled to a first of said pair of side members and wherein a second of said pair of rails is coupled to said first of said pair of side members; a bar having first, second, and third flat body surfaces which cooperatively form a trench; a first ball bearing assembly which operatively resides upon a first end of said first flat body surface and which movably resides within a first of said pair of rails; a second ball bearing assembly which operatively resides upon a second end of said first flat body surface and which movably reside within a second of said pair of rails, whereby said first and said second ball bearing assemblies cooperatively allow said bar to selectively and reciprocally move along and within said pair of rails and wherein said first flat body surface includes a channel proximate to said first ball bearing assembly and a second channel proximate to said second ball bearing assembly; a first hinge which is coupled to a first end of said second body flat body surface; a second hinge which is coupled to a second end of said second flat body surface; a first pivot member having a first end which is movably disposed within said second channel and a second end which is pivotally coupled to said back member; a second pivot member having a first end which is pivotally coupled to said first pivot member and a second end which is coupled to said first flat body surface; and a door which is coupled to said first and to said second hinges, whereby said first and second pivot members cooperate with said pair of rails and said first and second ball bearing assemblies to selectively allow said door to be selectively and wholly placed within said hollow interior cavity and to be movable from said position within said hollow interior cavity to a position outside of said hollow internal cavity, and wherein said first and second hinges cooperate to allow said door to move in an arc about said body when said door is selectively placed outside of said hollow internal cavity.

* * * * *